US006519806B2

(12) United States Patent
Tamborini et al.

(10) Patent No.: US 6,519,806 B2
(45) Date of Patent: Feb. 18, 2003

(54) HANDLE CONSTRUCTION FOR VACUUM CLEANERS

(76) Inventors: Ariberto Tamborini, Via XXV Aprile, 21020 Daverio (IT); Giancarlo Tamborini, Via XXV Aprile, 21020 Daveria (IT)

( * ) Notice: Subject to any disclaimer, the term of this patent is extended or adjusted under 35 U.S.C. 154(b) by 0 days.

(21) Appl. No.: 09/876,555

(22) Filed: Jun. 7, 2001

(65) Prior Publication Data

US 2002/0013976 A1 Feb. 7, 2002

(30) Foreign Application Priority Data

Jul. 28, 2000 (IT) ..... MI200000453 U

(51) Int. Cl.[7] ..... A47L 9/24

(52) U.S. Cl. ..... 15/339; 15/314; 15/410; 285/7

(58) Field of Search ..... 15/339, 410, 314; 285/7, 278, 280, 281

(56) References Cited

U.S. PATENT DOCUMENTS

| | | | | | |
|---|---|---|---|---|---|
| 3,565,464 | A | * | 2/1971 | Wolf | 285/7 |
| 5,109,568 | A | * | 5/1992 | Rohn et al. | 15/410 |
| 5,551,731 | A | * | 9/1996 | Gray et al. | 285/7 |
| 5,747,764 | A | * | 5/1998 | Son et al. | 15/410 |
| 5,755,578 | A | * | 5/1998 | Constant et al. | 285/7 |
| 5,884,358 | A | * | 3/1999 | Kim | 15/339 |

* cited by examiner

*Primary Examiner*—Theresa T. Snider
(74) *Attorney, Agent, or Firm*—Hedman & Costigan, P.C.

(57) ABSTRACT

A handle construction has a fixed position coupled to a tube which can be connected to the suction system, a movable portion, which can turn with respect to the fixed portion and having a suction inlet element, and an electric drive for driving the vacuum cleaner, which electric drive is coupled to the fixed portion of the handle.

3 Claims, 1 Drawing Sheet

HANDLE CONSTRUCTION FOR VACUUM CLEANERS

BACKGROUND OF THE INVENTION

The present invention relates to a handle construction for a vacuum cleaner, in particular for centralized cleaning systems.

Centralized vacuum cleaning systems conventionally comprise a plurality of fittings arranged in the rooms serviced by the system, the fittings being coupled to a centralized vacuum cleaner device to which a tube including a handle is connected.

The handle is conventionally provided with a switch for controlling the vacuum cleaner on/off operation through electric wires coupled to the tube and designed for coupling the control elements arranged on the handle to the fixed network coupled to the centralized cleaning system.

Since the handle must rotate through 360°, with respect to the tube, in order to facilitate the handling by the operator and preventing the tube from being undesirably deformed, it is necessary to provide complex systems to assure an electric contact to the control elements on the handle.

A prior system comprises, for example, a plurality of three brass circular contact strips, provided on a portion, on which slide three tongue or tab elements, coupled to the other portion.

This system, in addition to being very complex and expensive from a construction standpoint, is scarcely reliable, since it does not provide a perfect electric contact, and, moreover, is subjected to frequent failures and undesired switching off.

This is due to the fact that, since low voltage must be used for safety reasons (such as 12 or 24 volts), so-called false contacts frequently occurs because of dust depositing on the circular strips or a deformation of the contacting tab elements.

SUMMARY OF THE INVENTION

Accordingly, the aim of the present invention is to provide such a handle construction overcoming the above mentioned drawbacks of prior art vacuum cleaner handles.

Within the scope of the above mentioned aim, a main object of the present invention is to provide such a handle construction suitable to provide a reliable electric contact.

Yet another object of the present invention is to provide such a handle construction which is constructionally very simple and advantageous from a mere production standpoint.

According to one aspect of the present invention, the above mentioned aim and objects, as well as yet other objects, which will become more apparent hereinafter, are achieved by a handle construction comprising a fixed portion coupled to a tube to be connected to a suction system, a movable portion, turning with respect to said fixed portion and including a suction inlet element, an electric drive for driving the vacuum cleaner, and being characterized in that said electric drive is coupled to the fixed portion of the handle construction.

BRIEF DESCRIPTION OF THE DRAWINGS

Further characteristics and advantages of the present invention will become more apparent hereinafter from the following detailed disclosure of a preferred, though not exclusive, embodiment of the invention, which is illustrated, by way of a merely indicative, but not limitative, example, in the accompanying drawings, the sole FIGURE of which is a longitudinally cross-sectioned elevation view showing the handle construction according to the invention.

DETAILED DESCRIPTION OF THE PREFERRED EMBODIMENT

Figure 1:
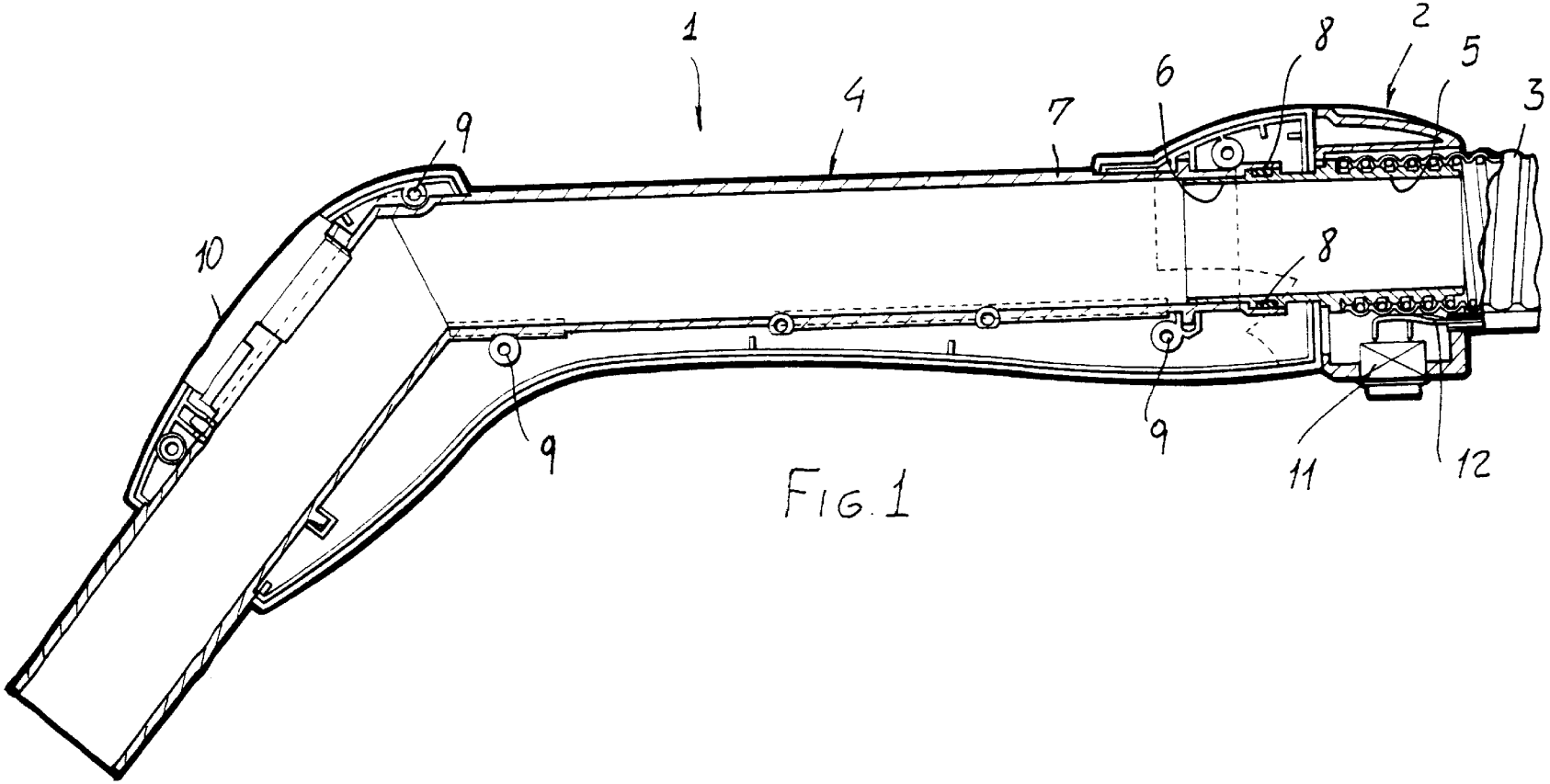

With reference to the number references of the above mentioned FIGURE, the handle construction according to the invention, which has been generally indicated by the reference number 1, comprises a fixed portion, including a rear body 2, coupled to a flexible tube or hose 3, and a movable portion, including a front body 4 rotatably coupled to the rear body 2.

The rear body 2 comprises a rear fitting 5 for tightly engaging the flexible tube or hose 3, and a front fitting 6 for rotatably engaging a central suction tube 7 of the front body 4, through the interposition of a sealing gasket 8, for example of a O-ring type.

The front body 4 is advantageously formed by two half shells, which can be coupled by coupling means, such as screws or the like, of which it is possible to show the seats 9.

The mentioned half-shells are partially overlapped onto one another, to provide the desired sealing and provide the front body with a suitable inclination, to facilitate its use, in a per se known manner.

Advantageously, the mentioned front body 4 is provided with a shutter element 10, for adjusting the suction therethrough.

According to the invention, the electric control elements of the handle construction comprise, in the preferred embodiment, an electric control switch 11, coupled to the rear body 2 of the handle and rigid therewith.

The electric control 11 is moreover coupled to conductive wires 12, connected to the flexible tube or hose 3.

Thus, it should be apparent that the handle construction according to the invention does not comprise any sliding contacts since the electric control element or elements are rigid with the flexible tube and do not intervene in the rotary movement of the handle with respect to the flexible tube.

Moreover, the electric control element can be easily accessed by an operator hand and can be easily operated; furthermore, it does not perform any rotary movement and is protected against dust, moisture and the like.

It has been found that the invention fully achieves the intended aim and objects.

In fact, a handle construction has been provided which can be easily operated and which, furthermore, is much more reliable and unexpensive than conventional handles including electric control elements.

In practicing the invention, the used materials, and their size and shapes, can be any, depending on requirements and the status of the art.

What is claimed is:

1. A handle construction for a vacuum cleaner device, comprising a fixed portion coupled to a flexible tube which can be connected to a suction system, a movable portion, rotatable with respect to said fixed portion and including a suction element, an electric control for operatively controlling said vacuum cleaner device, said electric control being connected to said fixed portion, wherein said fixed portion comprises a rear body, including a rear fitting, for tightly coupling to said flexible tube, and a front fitting to be rotatably coupled, through a sealing gasket, to a central suction tube of a front body constituting said movable portion.

2. The handle construction, according to claim 1, wherein said front body comprises two front body half-shells, which are tightly partially overlapped onto one another.

3. The handle construction, according to claim 1, wherein said front body comprises an air shutter element for adjusting suction therethrough.

* * * * *